US009255463B2

(12) United States Patent
Megill et al.

(10) Patent No.: US 9,255,463 B2
(45) Date of Patent: Feb. 9, 2016

(54) FLAPPER EQUALIZER WITH INTEGRAL SPRING

(71) Applicant: Baker Hughes Incorporated, Houston, TX (US)

(72) Inventors: Mark S. Megill, Tulsa, OK (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 452 days.

(21) Appl. No.: 13/711,341

(22) Filed: Dec. 11, 2012

(65) Prior Publication Data

US 2014/0158362 A1 Jun. 12, 2014

(51) Int. Cl.

| | |
|---|---|
| ***E21B 34/14*** | (2006.01) |
| ***E21B 34/10*** | (2006.01) |
| *E21B 34/00* | (2006.01) |

(52) U.S. Cl.
CPC ..... *E21B 34/101* (2013.01); *E21B 2034/005* (2013.01)

(58) Field of Classification Search
USPC ..... 166/321, 332.8
See application file for complete search history.

(56) References Cited

U.S. PATENT DOCUMENTS

| | | | | |
|---|---|---|---|---|
| 4,415,036 | A | 11/1983 | Carmody et al. | |
| 4,478,286 | A | 10/1984 | Fineberg | |
| 5,211,372 | A * | 5/1993 | Smith, Jr. | 251/75 |
| 6,644,408 | B2 | 11/2003 | Ives | |
| 6,848,509 | B2 | 2/2005 | Myerley | |
| 7,204,313 | B2 | 4/2007 | Williams et al. | |
| 8,056,618 | B2 | 11/2011 | Wagner et al. | |
| 2010/0051841 | A1 * | 3/2010 | Herbert et al. | 251/129.04 |
| 2010/0175887 | A1 * | 7/2010 | Henschel et al. | 166/373 |

OTHER PUBLICATIONS http://www.thefreedictionary.com/integral.*
http://www.thefreedictionary.com/fasten.*

* cited by examiner

*Primary Examiner* — Sean Andrish
(74) *Attorney, Agent, or Firm* — Steve Rosenblatt

(57) ABSTRACT

A flapper equalizer plunger embodies a unitary coiled spring that is compressed by the flow tube to shift the plunger to equalize pressure across the flapper before the flow tube tries to move the flapper. The hydraulic control system then need only to overcome the force of a flapper pivot spring to swing the flapper 90 degrees to an open position behind the flow tube. The integral spring is produced with a wire EDM technique and can be symmetrical or asymmetrical around its periphery as a way of offsetting off-center impact from the bottom of the flow tube. The plunger can be rotationally locked if it is asymmetrical. The pitch can be constant or variable and the output force greatly exceeds the force provided by an independent coiled spring.

19 Claims, 5 Drawing Sheets

FLAPPER EQUALIZER WITH INTEGRAL SPRING

FIELD OF THE INVENTION

The field of the invention is flapper type subsurface safety valves with a through-flapper equalizing feature and more particularly where the return spring is integral to the equalizing valve member.

BACKGROUND OF THE INVENTION

Subsurface safety valves are placed in tubular strings to allow shutting in the well for well control. They are actuated to open for production or injection with hydraulic control lines that extend from a surface location. One or two line systems have been used for valve control. The hydraulic pressure operates a rod or annular piston in the housing of the valve. The piston is linked to a flow tube in the passage through the valve. The piston is driven with hydraulic pressure in a control line against the bias of a closure spring. Movement of the piston against the spring takes the flow tube against the flapper that is biased with a pivot spring to a closed position. On contact with the flapper, the pivot spring is overcome as the flapper rotates 90 degrees and the flapper goes behind the advancing flow tube. The open position is maintained as long as pressure is supplied in the hydraulic control line. One removal of such pressure deliberately or through a system malfunction such as a seal leak the closure spring takes over and raises the piston that takes the flow tube with it to allow the pivot spring to move the flapper to the closed position.

When the flapper is in the closed position there is a large pressure differential potential that can appear across it making it difficult for the hydraulic system to provide the required force to open the flapper with the flow tube without component damage. To address this problem in the past equalizer plungers have been placed in the flapper at a location where the descending flow tube would engage the plunger to open a bypass passage through the flapper before the flow tube was brought into contact with the flapper itself for rotation to the open position. In this manner the pressure across the flapper was equalized before the flow tube was in contact with it to rotate it. In this case only the force of the pivot spring needed to be overcome to open the flapper. The prior designs all employed springs to return the equalizer plunger back to a sealed position when the flow tube no longer contacted the plunger. This was done with leaf or coil springs as illustrated in these U.S. Pat. Nos. 4,478,286; 6,644,408; 7,204,313; 6,848,509; 4,415,036 and 8,056,618. Referring specifically to U.S. Pat. No. 7,204,313 the problem was that the spring 86 would not stay mounted to the plunger 86 by moving off its mount flange 70. Another issue was that the shape and length of the spring resulted in a very minimal closing force applied to the plunger in the order of about two pounds. One of the reasons that the spring could be moved off its flange mount is that the plunger is normally struck by the flow tube in an off center manner which could have put a slight turning moment on the plunger sufficient to dislodge the spring from its mounting flange. Without the spring in position to push the plunger to its closed position the safety valve became inoperative as there was a perpetual bypass flow through the flapper in the closed position. This was a safety issue that needed to be addressed.

The present invention addresses these concerns with a design where the spring is integrally fabricated in the plunger body using techniques known as wire EDM (Electrical Discharge Machining) or more familiarly "turn and burn." As a result a spring is integrated into the plunger that can put out substantially higher closing force without taking up incremental space and this allows less of the flapper body to be removed. The integral design can be symmetrical or asymmetrical and the plunger in an asymmetrical design can be keyed to prevent rotation and the spring designed to generate more force on one side to better counter act the side loading force from off-center contact from the flow tube. These and other features of the invention will be more apparent to those skilled in the art from a review of the detailed description of the preferred embodiment and the associated drawings while recognizing that the full scope of the invention is to be found in the appended claims.

SUMMARY OF THE INVENTION

A flapper equalizer plunger embodies a unitary coiled spring that is compressed by the flow tube to shift the plunger to equalize pressure across the flapper before the flow tube tries to move the flapper. The hydraulic control system then need only to overcome the force of a flapper pivot spring to swing the flapper 90 degrees to an open position behind the flow tube. The integral spring is produced with a wire EDM technique and can be symmetrical or asymmetrical around its periphery as a way of offsetting off-center impact from the bottom of the flow tube. The plunger can be rotationally locked if it is asymmetrical. The pitch can be constant or variable and the output force greatly exceeds the force provided by an independent coiled spring.

DETAILED DESCRIPTION OF THE PREFERRED EMBODIMENT

Figure 1:
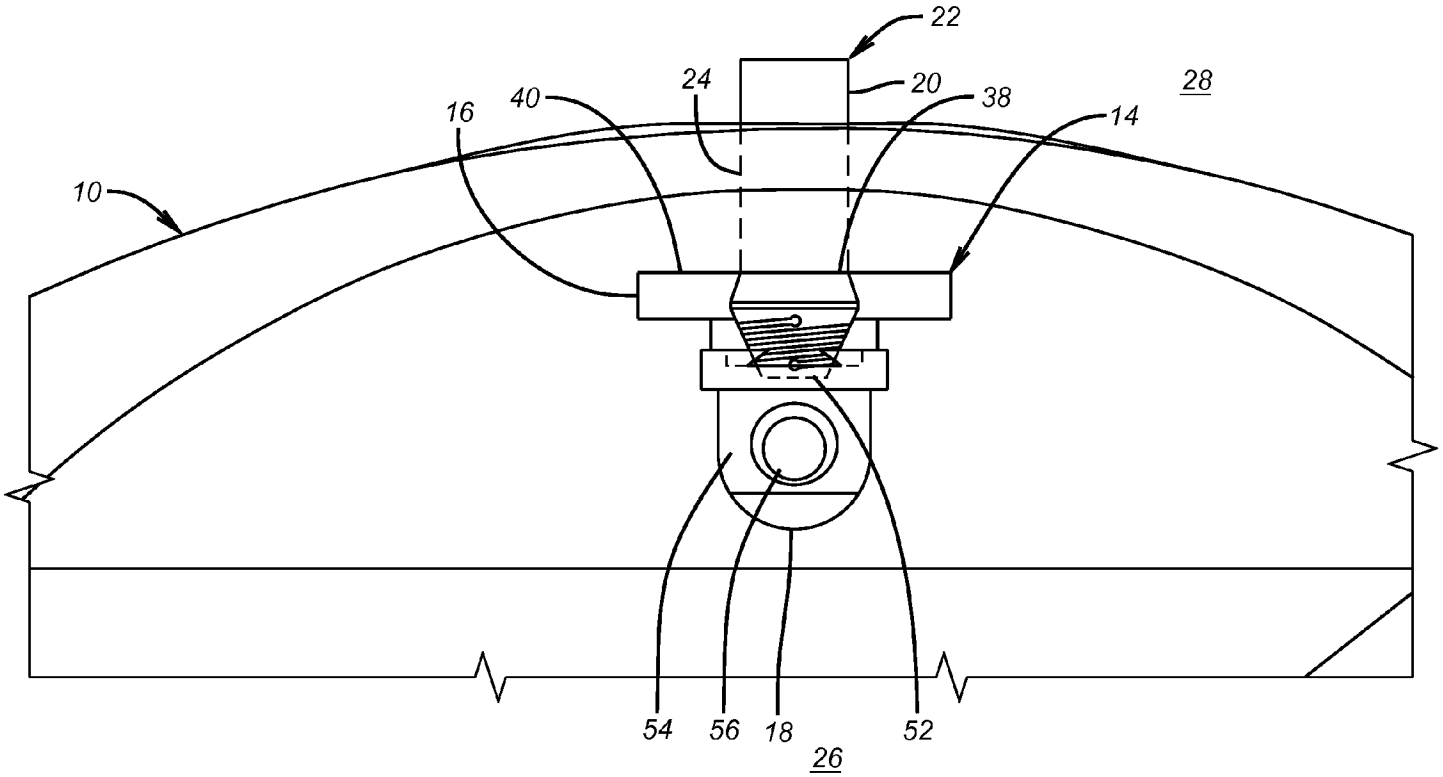
FIG. 1 is an elevation view of the plunger in the closed position.

Referring to FIG. 1 an end view is shown of a closure or flapper 10 illustrating on the downhole side 26 an end slot 14 having a generally rectangular upper shape 16 and a lower U-shape 18. The slot configuration is the same as in FIG. 3 of U.S. Pat. No. 7,204,313. The height of the U-shape 18 is sufficient to get the shaft 20 of valve member or plunger 22 inserted through a bore 24 in the flapper 10. When the flapper 10 is in the closed position pressure builds at the downhole side 26 so that there is a differential to the uphole side 28 as long as the plunger 22 obstructs the bore 24.

Figure 4:
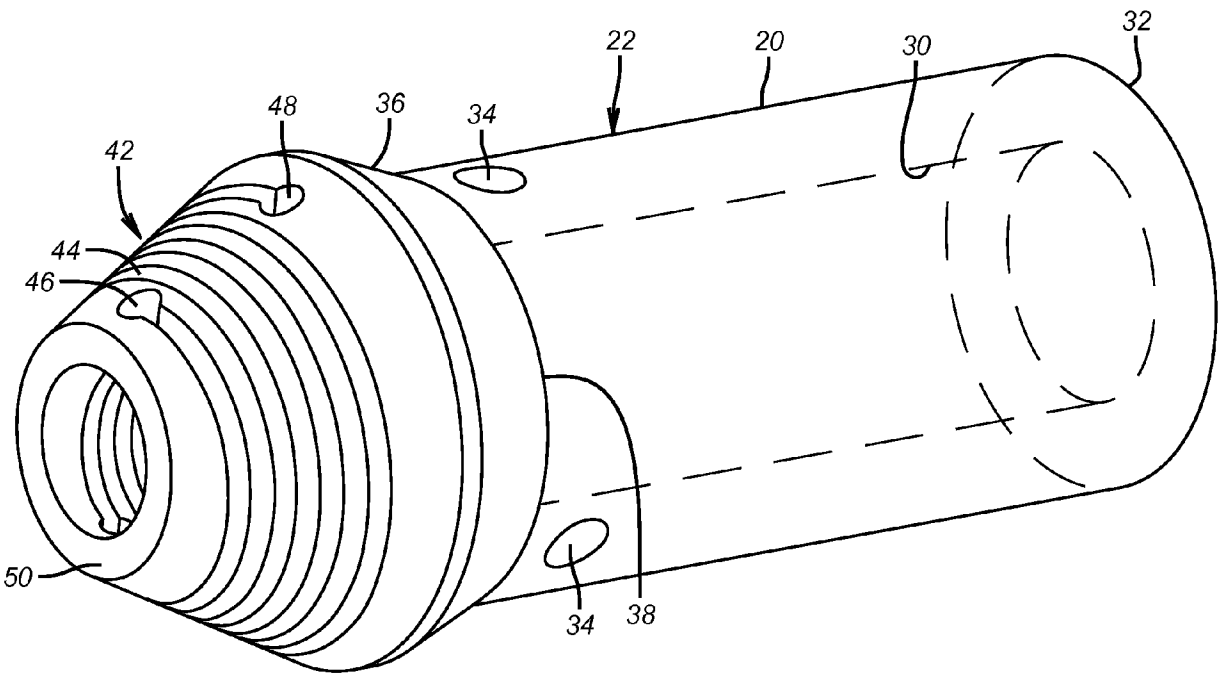
FIG. 4 is a perspective view of the plunger.
Figure 5:
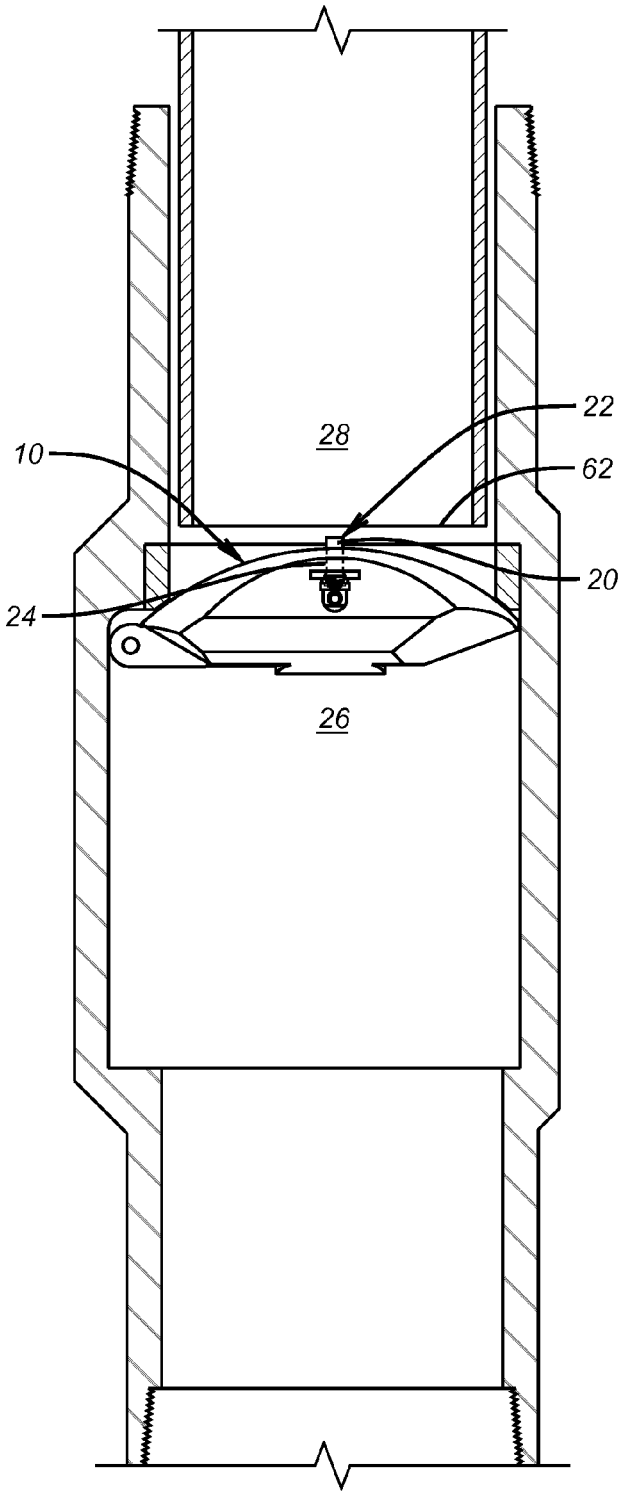
FIG. 5 is a section view of the subsurface safety valve assembly.

Referring to FIG. 4 the shaft 20 of the plunger 22 has a blind bore 30 that runs from the upper end 32 to below the lateral ports 34. Below the bore 30 and on the outer periphery of shaft 20 is an outwardly tapering surface 36 that starts from a radial surface 38 that acts as an uphole travel stop for the plunger 22 when it engages surface 40 of slot 16 as shown in FIG. 1.

Figure 3:
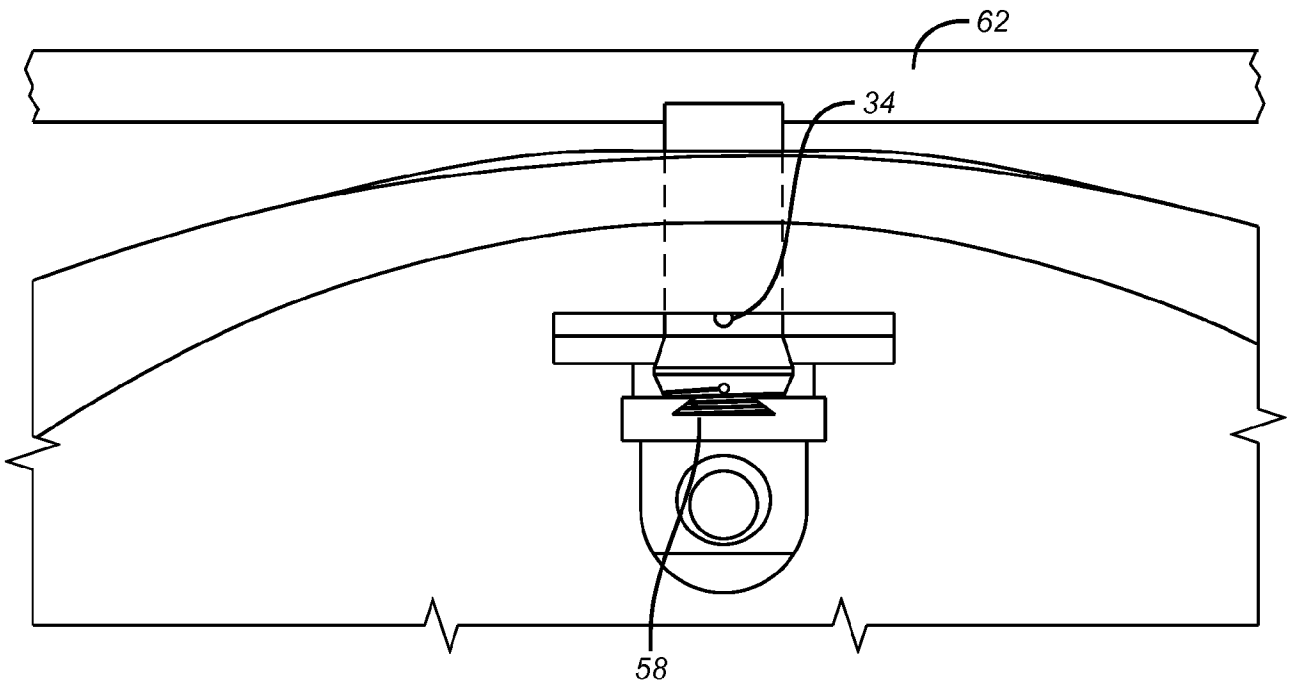
FIG. 3 is similar to FIG. 2 showing the plunger being contacted by a schematically illustrated flow tube.

Below tapered surface 36 is the integral biasing component which preferably is a tapered end 42 into which there is a spiral cut 44 that has enlarged bores 46 and 48 at opposed ends to mitigate stress fractures at what would otherwise be a zone of stress concentration. The tapered end is preferably hollow so that the spiral cut 44 will allow it to function as a spring. The lower end 50 slides into a complementary groove 52 on retainer nut 54 as shown in FIG. 1. A retainer, not shown, such as a screw or bolt goes through opening 56 and into threads in the flapper 10 which are not shown. This keeps the retainer nut 54 in position. In essence the shaft 20 of the plunger 22 is inserted through bore 24 and then the nut 54 slides into position so that it can be fastened to the flapper 10 with the lower end 50 of the plunger 22 guided by groove 52. As shown in FIG. 3, groove 52 secured by a pocket 58 in the retainer nut.

FIG. 3 schematically shows the actuator or flow tube 62 engaging the shaft 20 of the plunger 22 and pushing it down so that ports 34 extend past surface 40 in slot 16 so that equalizing flow can take place across the flapper 10 through blind bore 30 and out ports 34. When the flow tube is retracted and the flapper 10 is in the closed position, the tapered end 42 acts as a spring to force the plunger 22 up until the radial surface 38 engages surface 40 in slot 16 of the flapper 10.

Figure 2:
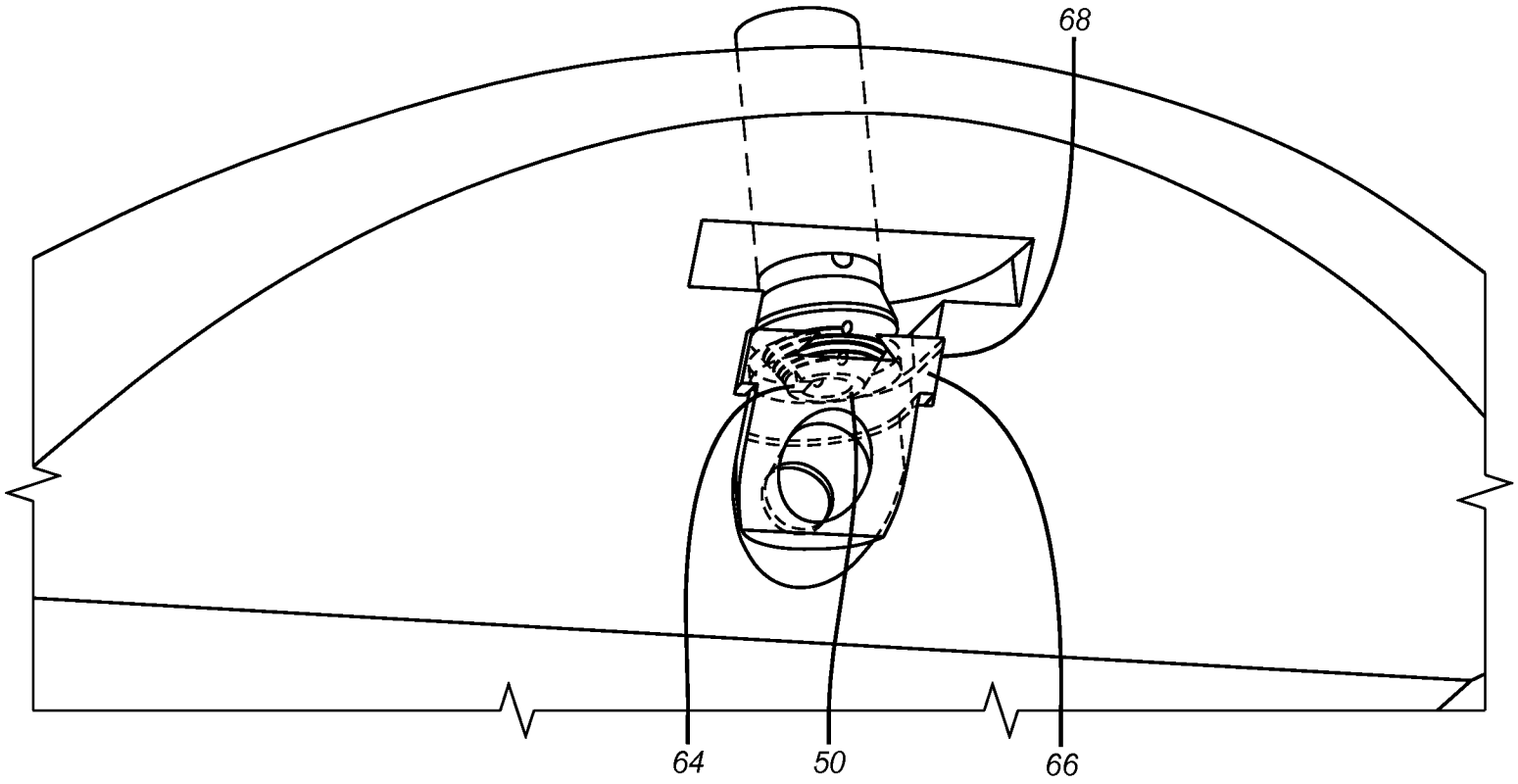
FIG. 2 is the view of FIG. 1 with the plunger in the equalize position.

Referring to FIG. 2 the lower end 50 can have a notch 64 to prevent rotation of the plunger 22 about its axis. This can be important especially if the tapered section 42 has asymmetry in a circumferential segment. For example the spiral cut 44 can be narrower in some segment than in other segments to add more spring force to one side of the plunger to counteract off center contact from the flow tube 62 onto the upper end 32 of the plunger 22. The notch 64 straddles a key that is not shown in the nut 54 that itself is rotationally locked with flange 66 fitting into slot segment 68.

Various options are envisioned. The tapered section 42 can be cylindrical or some other shape. The spiral cut 44 can be replaced with other patterns of material removal to get a spring action in the lower end of the plunger 22. The interaction between surfaces 38 and 40 can be metal to metal or there can be an added seal on one of the surfaces such as in a groove with a seal ring in the groove to contact the opposing surface. The spiral cut 44 can have a uniform pitch and uniform width or the pitch can vary as can the width of cut. The wall thickness of the lower end can be symmetrically uniform or asymmetric. The generated spring force can be in the order of hundreds of pounds as compared to the small coiled springs used in the past that put out only a few pounds of force. The number and shape of the opening 34 can be varied. The tapered end 42 can be a different material than the shaft 20. The end 42 can be metallic, composite, a resilient material or a shape memory alloy. Using the shape memory alloy the well fluids can bring the end 42 above its transition temperature to gain a boost in the delivered biasing force for a delivery of a force in the order of 200 pounds or more whereas the existing separate springs that are now used deliver in the order of between 1.8 and 2.2 pounds of force. End 42 can be a solid shape that has the spiral cut 44 or some other pattern of material removal to allow it to act as a spring. Alternatively the end 42 can be a block of resilient material that has some shape memory and therefore can replicate the action of a spring. "Integrally" means made of a single piece or of a plurality of pieces that are not non-destructively separable. Apart from solid or tubular shapes that have material removed so that they approximate the operation of a coiled spring, other techniques can be used such as a solid shape of a resilient and non-swelling material that is simply compressed by the flow tube 62 and then regains its shape as the flow tube 62 is raised.

The above description is illustrative of the preferred embodiment and many modifications may be made by those skilled in the art without departing from the invention whose scope is to be determined from the literal and equivalent scope of the claims below.

We claim:

1. A subsurface safety valve for subterranean use, comprising:

a housing having a passage therethrough;

a closure selectively movable with respect to a seat that surrounds said passage;

an actuator member in said passage to selectively move said closure with respect to said seat;

said closure having a bore that communicates opposed sides of said closure and further comprising a valve member having a longitudinal axis and slidably mounted in said bore, said valve member and a biasing component that creates a force from being compressed, said valve member and said biasing component integrally fastened to each other and said valve member and said biasing component disposed in axial alignment with each other and substantially in said bore to bias said valve member from said closure to a bore obstructed position.

2. The valve of claim 1, wherein:

said biasing component has an annular shape defined by a wall with multi-planar portions of said wall removed or a solid shape with multi-planar portions removed which builds a bias force in response to a reduction in dimension of said removed portions in a direction of said longitudinal axis.

3. The valve of claim 2, wherein:

said wall or solid shape comprises a taper.

4. The valve of claim 2, wherein:

said removed portions of said wall or solid shape comprising a spiral.

5. The valve of claim 4, wherein:

said spiral has a constant or variable pitch.

6. The valve of claim 4, wherein:

said spiral has a fixed or variable width.

7. The valve of claim 4, wherein:

said wall has a fixed or variable wall thickness or said solid shape has a uniform or variable density.

8. The valve of claim 4, wherein:

said wall or spiral has a circumferential asymmetry.

9. The valve of claim 8, wherein:

said valve member is rotationally locked in said bore.

10. The valve of claim 4, wherein:

said spiral comprises opposed ends having an enlarged dimension.

11. The valve of claim 4, wherein:

said valve member further comprises a radial surface that selectively engages said closure under a force delivered by said integral biasing component.

12. The valve of claim 11, wherein:

said valve member comprising a blind bore starting from an opposite end from said integral biasing component and having at least one lateral outlet that is selectively closed off by said force from said integral biasing component.

13. The valve of claim 12, wherein:

said actuator overcomes said force from said integral biasing component to take said lateral outlet out of said bore when contacted by said actuator before said actuator operates said closure;

said closure comprises a flapper.

14. The valve of claim 13, wherein:

said wall or solid shape comprises a taper.

15. The valve of claim 4, wherein:

said valve member, including said integral biasing component, is a one piece component.

16. The valve of claim 4, wherein:

said integral biasing component applies at least a 5 pound closure force against said closure.

17. The valve of claim 4, wherein:

said integral biasing component comprises at least one of a metal, a metal alloy, a shape memory alloy and a resilient material.

18. The valve of claim 4, wherein:

said integral biasing component is retained in said closure with a retaining nut having a retaining pocket.

19. The valve of claim 2, wherein:

said annular shape defining said wall comprises an open lower end.

* * * * *